US005464357A

United States Patent [19]

Craig et al.

[11] Patent Number: 5,464,357

[45] Date of Patent: Nov. 7, 1995

[54] JET PUMP EXHAUST SYSTEM

[75] Inventors: W. Scott Craig, Kenosha, Wis.; Charles B. Hall, Ingleside; Edward K. Lam, Wadsworth, both of Ill.; Duane E. Rogers, Kenosha, Wis.

[73] Assignee: Outboard Marine Corporation, Waukegan, Ill.

[21] Appl. No.: 147,973

[22] Filed: Nov. 5, 1993

[51] Int. Cl.[6] ..... B63H 21/32

[52] U.S. Cl. ..... 440/89

[58] Field of Search ..... 440/88, 89; 181/212, 181/213, 215, 227, 240, 255, 264

[56] References Cited

U.S. PATENT DOCUMENTS

| | | | |
|---|---|---|---|
| 2,735,504 | 2/1956 | Moyer . | |
| 3,948,206 | 4/1976 | Tyler . | |
| 3,968,767 | 7/1976 | Blanchard . | |
| 4,631,032 | 12/1986 | Nishida . | |
| 4,652,244 | 3/1987 | Drury . | |
| 4,707,986 | 11/1987 | Takada et al. . | |
| 4,713,029 | 12/1987 | Ford . | |
| 4,773,883 | 9/1988 | Nakase et al. . | |
| 4,779,704 | 10/1988 | Akiyama . | |
| 4,811,560 | 3/1989 | Nakase et al. . | |
| 4,917,640 | 4/1990 | Miles, Jr. . | |
| 4,989,409 | 2/1991 | Nakase et al. . | |
| 4,997,399 | 3/1991 | Nakayasu et al. . | |
| 5,007,870 | 4/1991 | Okubo et al. . | |
| 5,016,439 | 5/1991 | Nitta . | |
| 5,045,005 | 9/1991 | Miles, Jr. . | |
| 5,078,631 | 1/1992 | Harbert | 440/89 |
| 5,096,446 | 3/1992 | Tazaki et al. . | |
| 5,196,655 | 3/1993 | Woods | 440/89 |

*Primary Examiner*—Stephen Avila
*Attorney, Agent, or Firm*—Greer, Burns, Crain, Ltd.

[57] ABSTRACT

An exhaust system for a marine jet pump with an internal combustion power head includes a muffler having a muffler inlet in fluid communication with the power head to receive exhaust gases therefrom, and a muffler outlet for emitting the exhaust gases, the muffler further including an exhaust high rise portion being vertically displaced from the inlet and the outlet to prevent the entry into the muffler inlet of water passing into the interior through the muffler outlet.

19 Claims, 5 Drawing Sheets

JET PUMP EXHAUST SYSTEM

RELATED APPLICATIONS

This application is related to copending, commonly-assigned applications entitled: ADAPTOR PLATE MOUNTING SYSTEM FOR MARINE JET PROPULSION UNIT, U.S. Ser. No. 08/147,880, filed Nov. 5, 1993; and, MARINE PROPULSION UNIT HAVING EXTERIORLY ACCESSIBLE CLEAN-OUT CAPABILITY AND FLUSHING DEVICE FOR SAME, U.S. Ser. No. 08/147,976, filed Nov. 5, 1993; and JET PUMP MOUNTING SYSTEM, U.S. Ser. No. 08/147,933, filed Nov. 5, 1993.

BACKGROUND OF THE INVENTION

The present invention relates generally to exhaust systems for marine jet propulsion units, and specifically to exhaust systems for relatively higher-powered, inboard mounted marine jet propulsion units having indirect drive systems, and preferably designed for installation in multi-passenger watercraft.

Conventional marine jet propulsion units are designed to be used instead of propeller-driven outboard or inboard marine motors. Some of the more significant advantages of jet propulsion units include the lack of a depending gear case, which allows the craft to have minimum contact with the water surface at high speed. This feature of jet propulsion units enables the operator to make tight turns while maintaining the boat in a generally horizontal orientation. Another feature of marine jet propulsion units is that the lack of a depending propeller enables the craft to be operated in shallower water without fouling.

An important design consideration of exhaust systems for marine jet propulsion units is that when a watercraft equipped with a jet propulsion unit is under way, the stern of the craft will be elevated from the water surface. The degree of elevation depends in part on the speed of the craft. While at low speed, the engine exhaust is emitted into the water, as speed increases, engine exhaust is emitted into the air, creating a noise suppression problem which requires attenuation of a wide range of frequencies. This is in contrast to conventional outboard marine engines, wherein at high speed, the exhaust is emitted directly into the water.

Another design consideration of marine jet propulsion units is that ambient water is used to cool the exhaust system, and the cooling water is returned to the ambient body of water simultaneously with the emission of the exhaust from the propulsion unit. Although elevated at the stern while under way, once the boat equipped with such a propulsion unit slows down, the stern submerges, and water has the tendency to migrate back into the engine through the exhaust system if not arrested in some way.

Still another design factor of marine jet propulsion exhaust systems is that a wide range of frequencies must be attenuated to provide sufficient noise reduction for pleasant boating, while not restricting the exhaust gas flow from the engine. Conventional marine muffler technology has been found to be unsatisfactory in attenuating all target frequencies in jet propulsion units without unduly restricting engine exhaust gas flow.

Accordingly, a first object of the present invention is to provide an exhaust system for a marine jet pump unit which provides sufficient sound attenuation without detracting from the flow of engine exhaust gases.

Another object of the invention is to provide an exhaust system for a marine jet pump unit which protects the engine from the inflow of ambient water, especially while the stern of the boat powered by the jet pump is submerged.

A further object of the present invention is to provide an exhaust system for a marine jet pump which may be tailored to attenuate specific target frequencies.

Yet another object of the present invention is to provide an exhaust system for a marine jet pump which cools the exhaust prior to emission into the ambient environment.

SUMMARY OF THE INVENTION

Accordingly, the above-identified objects are met or exceeded by the present exhaust system, which features a high rise portion located within a muffler casing to prevent ambient water from backing up into the engine, a cooling system for directing ambient water into the exhaust system for cooling the exhaust gases, and employing a resonator for attenuating specific frequencies. In some cases, the resonator is unitary with an expansion chamber, and in other cases the resonator is supplied as a separate tube downstream from the muffler in the exhaust system.

More specifically, an exhaust system for a marine jet pump with an internal combustion power head connected to a pump unit includes a muffler provided with a muffler inlet in fluid communication with the power head to receive exhaust gases therefrom, and a muffler outlet for emitting the exhaust gases, and an exhaust high rise portion having an outlet being vertically displaced from the inlet and the outlet to prevent the entry into the muffler inlet of cooling water passing into the interior through the muffler outlet.

In another embodiment, an exhaust system for a marine jet pump with an internal combustion power source includes a muffler having a muffler inlet in fluid communication with the power source to receive exhaust gases therefrom, and a muffler outlet for emitting the exhaust gases. An expansion chamber is located within the interior of the casing and is in fluid communication with the muffler inlet and the muffler outlet. There is an abrupt area change between the expansion chamber and the muffler inlet, and the expansion chamber has an area substantially greater than an area of the muffler inlet, and a length designed to attenuate exhaust noise generated by the power source. A resonating device in fluid communication with the muffler inlet and in some embodiments located within the muffler casing is provided for suppressing or attenuating audible frequencies emitted by the power source.

In still another embodiment, an exhaust system is provided for a marine jet pump with a power head connected to a pump unit and having a vertically oriented crankshaft, the power head configured so that exhaust gases are emitted from a bottom end of the power head. The exhaust system includes a muffler having an inlet in fluid communication with the power head to receive exhaust gases therefrom, and a muffler outlet for emitting the exhaust gases, the muffler inlet and the muffler outlet being disposed at a lower end of the muffler so that the muffler defines an exhaust high rise portion for preventing the entry of water into the power head.

DESCRIPTION OF THE PREFERRED EMBODIMENT

Figure 1:
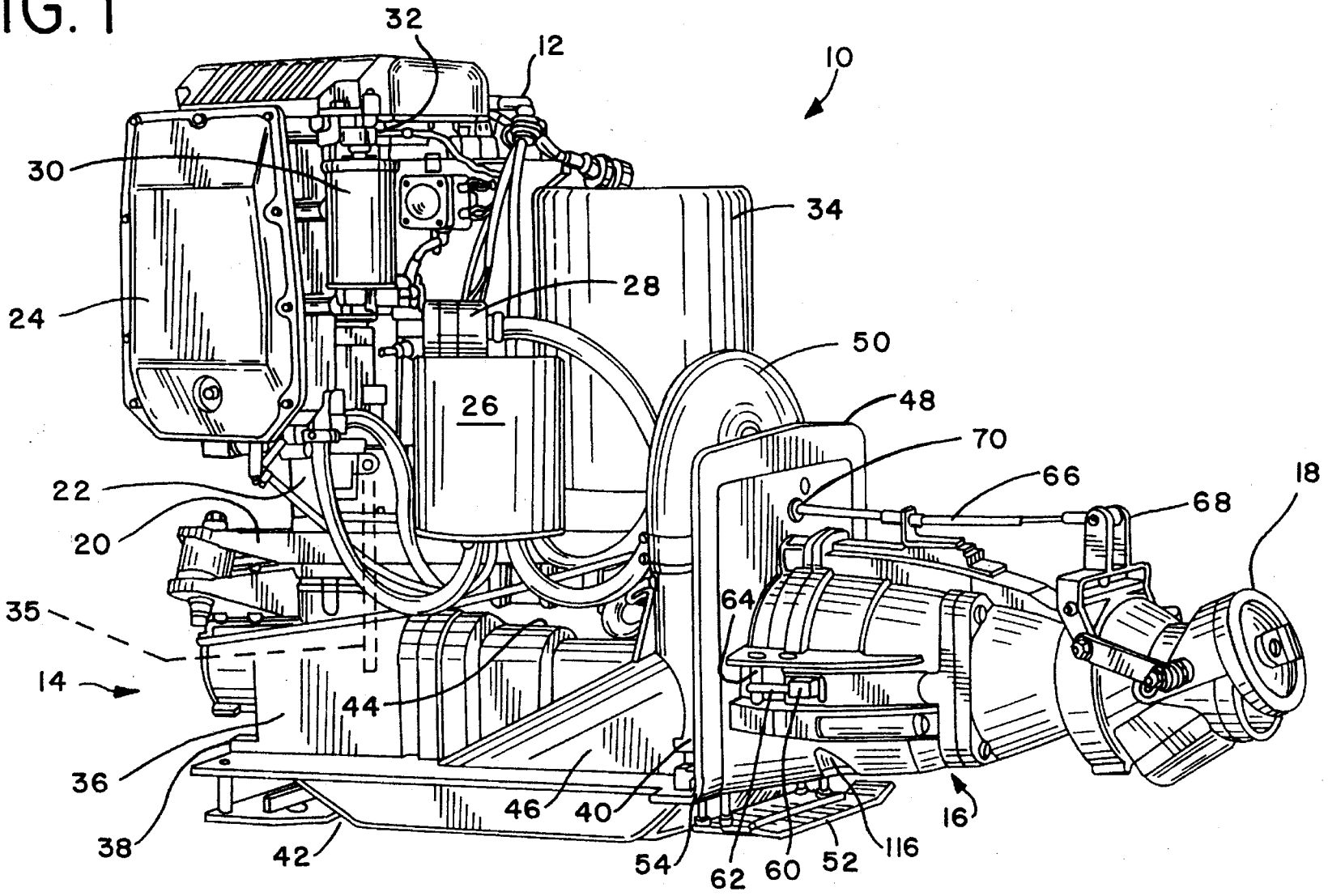
FIG. 1 is a perspective elevational view of a marine power head and jet pump assembly employing the present exhaust system.
Figure 2:
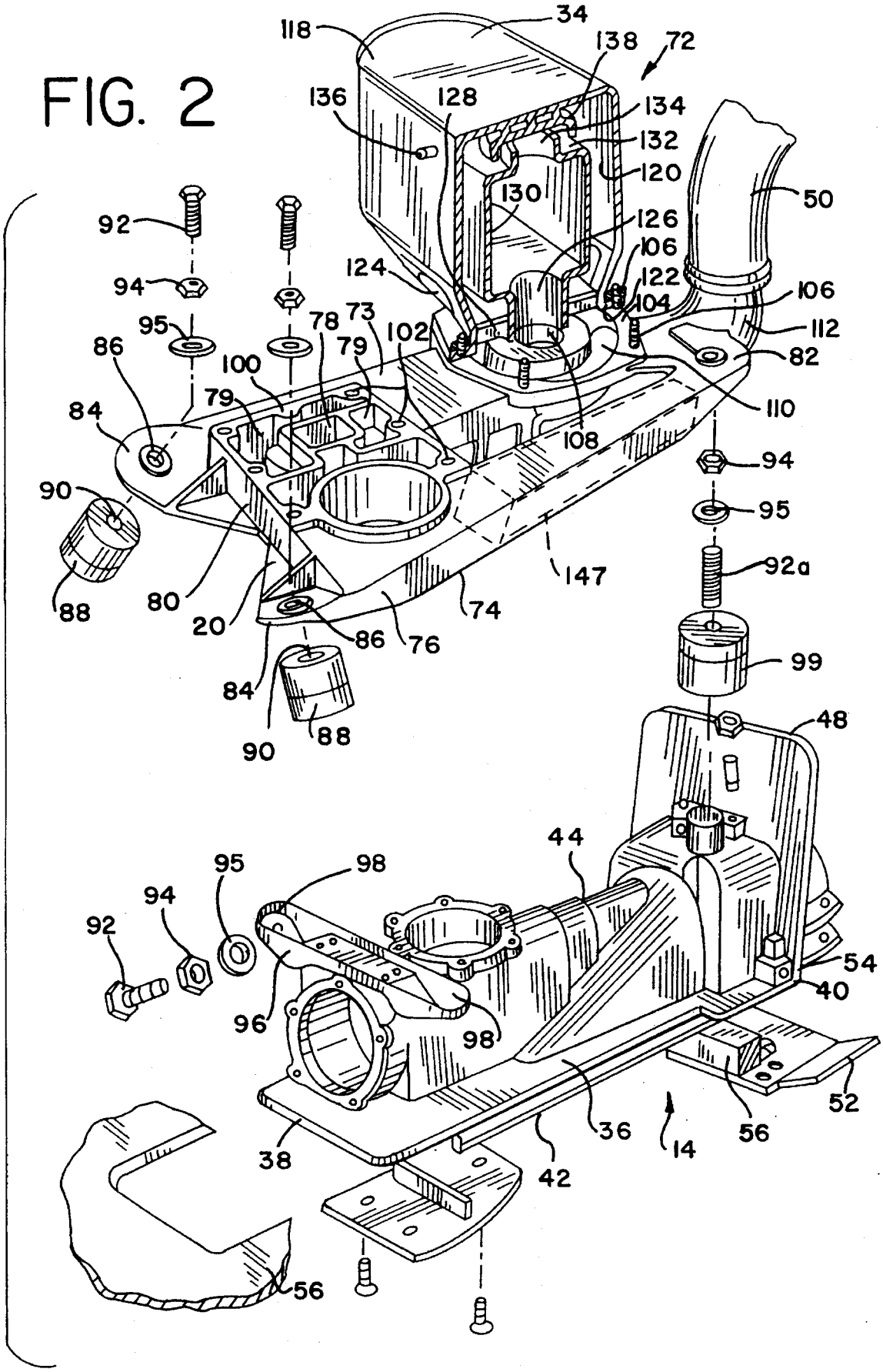
FIG. 2 is an exploded fragmentary perspective view of the pump unit of FIG. 1, wherein portions of the present exhaust system are shown cut away.

Referring now to FIGS. 1 and 2, a marine jet propulsion unit of the type suitable for use with the present exhaust system is generally designated 10. The unit 10 is designed for mounting inboard fashion into the hull of a watercraft, preferably a multi-passenger boat. However, the use of the present propulsion unit with other appropriate watercraft is contemplated. Major components of the propulsion unit 10 are a power head or engine 12, and a pump unit 14 which includes an impeller housing 16, a reverse gate 18 connected to the impeller housing 16, and an adaptor plate 20 disposed between the power head 12 and the pump unit 14.

The power head 12 in the preferred embodiment is a conventional three cylinder, two-cycle marine power unit including an engine block 22, an air silencer device 24, a fuel pump 26, a fuel filter 28 connected to the fuel pump, an electric starter 30 connected to a flywheel assembly 32, and the present muffler 34. In an embodiment as depicted in FIG. 1, the power head 12 is capable of generating in the range of 70–90 horsepower, although power units of both smaller and larger power ratings and having a variety of cylinder configurations are suitable for use with the present jet propulsion unit. The power head 12 also is disposed on the pump unit 14 so that a power head crankshaft 35 (shown hidden in FIG. 1) depends vertically into the pump unit.

Referring now to the pump unit 14, the unit includes a housing 36, also referred to as a gear housing, having a fore end 38, an aft end 40, an underside 42 and an upper surface 44. Included in the underside 42 is a water intake grille (not shown) which permits the entry of ambient water into a water conduit or passageway designated 46. At the aft end 40 is found a transom plate 48 which is integrally formed with the housing 36, as by casting, and a flexible exhaust hose 50. A ride plate 52 is mounted to the underside 42 of the housing 36, and is located in vertically spaced, depending relationship relative to a lower end 54 of the transom plate 48. A portion of the hull 56 of the watercraft to which the present unit 10 is mounted is sandwiched between a portion of the ride plate 52 and the underside 42 of the housing 36 (best seen in FIG. 2).

The impeller housing 16 is releasably connected to the gear housing 36 by a pair of diametrically opposed clips 60 which each include a hook portion 62 constructed and arranged to engage a post 64 secured to an aft end of the transom plate 48. A gear shift cable 66 is connected to the reverse gate 18 through a linkage 68 and passes through a grommeted aperture 70 in the transom plate 48.

Referring now to FIG. 2, the adaptor plate 20 is shown exploded away from the pump unit 14 to depict features of the present exhaust system, generally designated 72. Although having a generally planar or relatively flattened configuration, the adaptor plate 20 is basically a cast hollow component, having a generally planar upper surface 73, a lower surface 74 and a sidewall 76. The sidewall 76 defines an internal space or passageway 78 and maintains the lower surface 74 in vertically spaced relationship from the upper surface 72.

Included on the plate 20 is a fore end 80 and an aft end 82 corresponding to the fore and aft ends 38, 40 of the gear housing 36. At the fore end 80 of the plate 20 are located a pair of mounting ears 84, each provided with a throughbore 86, and each ear and throughbore form an adaptor plate mounting bracket. An elastomeric, resilient bushing 88 is provided for each of the mounting ears 84. Each bushing 88 has an internally threaded upper sleeve 90 and a corresponding lower sleeve (not shown). A threaded fastener 92, locknut 94 and washer 95 are preferably employed to lockingly secure the plate 20 to each of the bushings 88. However, other equivalent fastener assemblies are contemplated.

At the fore end 80 of the plate 20, the bushings 88 are secured to the gear housing 36 by an engine mount arm 96 fixed to the fore end of the housing and having an opposed pair of angled pockets or seats 98. Each seat 98 is dimensioned to accommodate one of the bushings 88, which is secured therein by a threaded fastener, locknut and washer assembly 92, 94 and 95. Each bushing 88 is thus disposed between the ears 84 and one of the bushing pockets 98. A rear bushing 99 is lockingly disposed at the aft end 82 of the adaptor plate 20 using a threaded stud-type fastener **92*a*, a locknut 94 and a washer 95 to provide a three-point attachment of the adaptor plate to the pump housing 36**.

Moving toward the aft end 82 from the ears 84, the plate 20 further includes a crankcase mounting point 100 configured to receive the power head 12. The power head 12 is secured to the mounting point 100 by threaded fasteners (not shown) which engage a plurality of mounting apertures 102 on the mounting point 100. The mounting point 100 is in fluid communication with the passageway 78 to receive exhaust gases emitted by the power head 12, which are forced downwardly into the passageway 78. It will be appreciated that the power head 12 is designed to be cooled by circulating ambient water, and that the adaptor plate is placed in fluid communication with the cooling galleries of the power head 12 through the cooling ports 79 which surround the passageway 78.

Further towards the aft end 82 is located a muffler attachment 104 including a plurality of attachment studs 106, a centrally located exhaust outlet 108 in communication with the power head 12 through the passageway 78, and a peripherally disposed exhaust inlet 110. The muffler 34 is attached to the studs 106 and is in fluid communication with the exhaust outlet 108 and the inlet 110. An exhaust conduit 112 located at the aft end 82 receives exhaust from the exhaust inlet 110, and is in turn connected to the exhaust hose 50 which ultimately passes exhaust out the exhaust ports 116 (best seen in FIG. 1). The exhaust system 72 includes the adaptor plate 20, the muffler 34, the exhaust conduit 112, the exhaust hose 50 and the exhaust ports 116.

Figure 3:
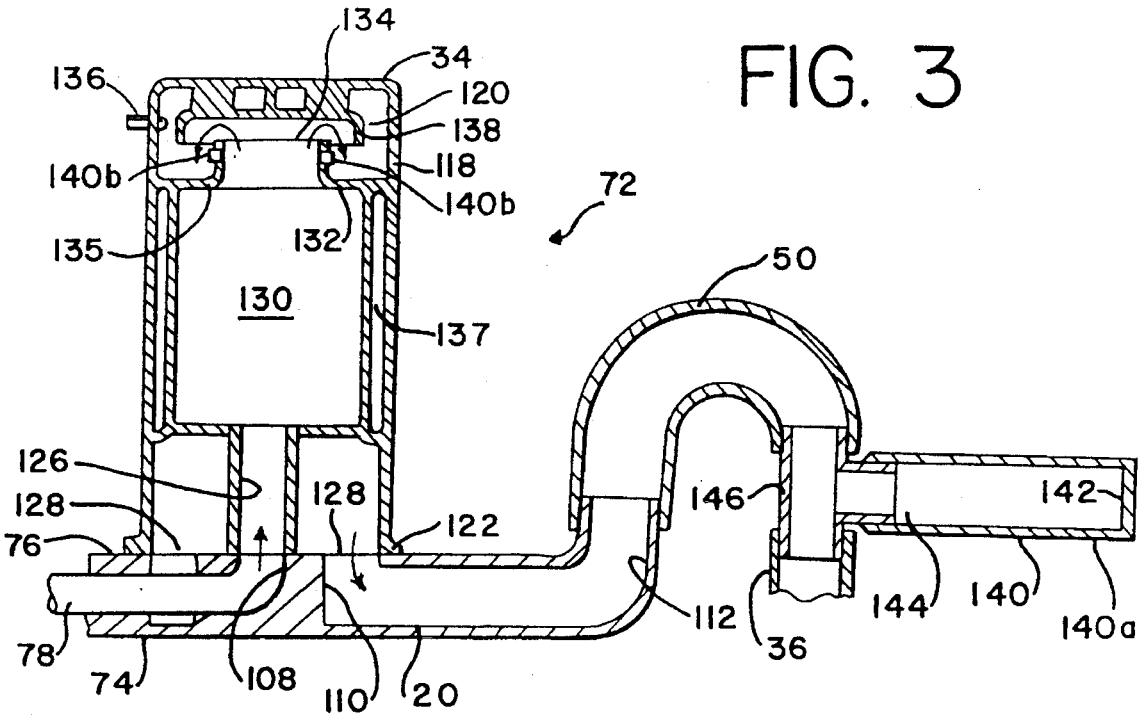
FIG. 3 is a vertical sectional view of the preferred embodiment of the present exhaust system.

Referring to FIGS. 2 and 3, the muffler 34 will now be described in greater detail, and includes a muffler casing 118 defining an interior space 120 and having a lower mounting flange 122 for fastening to the muffler attachment 104. The casing 118 preferably includes recesses or cutouts 124 at the lower end to facilitate the assembler's access to the attachment studs 106. Locknuts (not shown) or other suitable fasteners are employed to secure the flange 122 to the studs 106. Included in the interior space 120 is a muffler inlet 126 in fluid communication with the exhaust outlet 108, and a muffler outlet 128 in fluid communication with the exhaust inlet 110. In the preferred embodiment, the inlet 126 and the outlet 128 are substantially coplanar.

Figure 7:
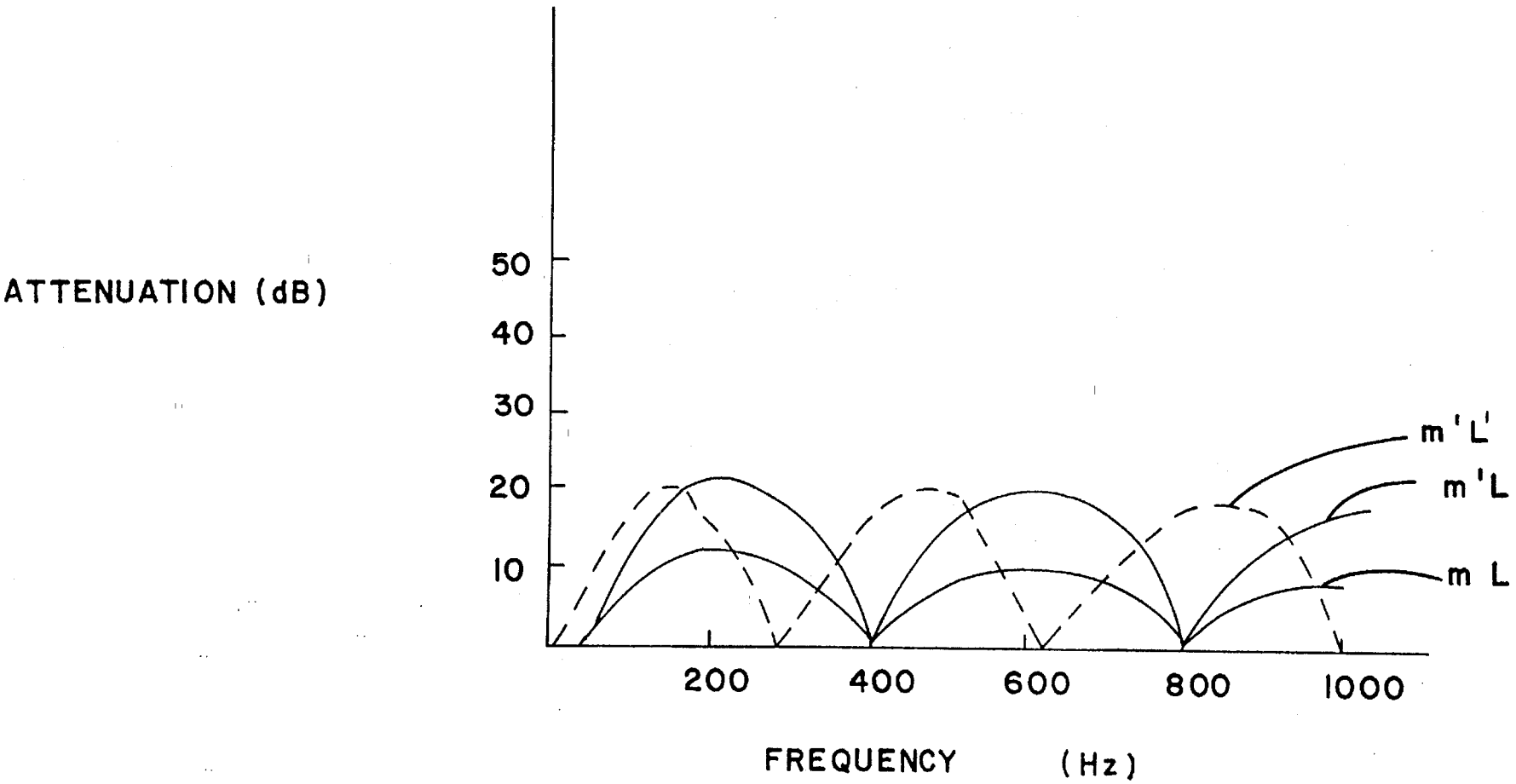
FIG. 7 is a diagrammatic representation of the relationship of frequency attenuation as affected by expansion chamber length and the ratio of expansion chamber area to muffler inlet area.

Referring now to FIGS. 2, 3 and 7, the muffler inlet 126 is preferably a tubular portion of a relatively small diameter for optimum noise reduction, however it also is preferably of sufficient diameter to prevent any restriction of exhaust gas flow from the power head 12. At the end of the inlet 126, which is opposite the exhaust outlet 108, is found an expansion chamber 130 in fluid communication with the muffler inlet 126. The ratio m of the area of the expansion chamber 130 to the area of the exhaust inlet 126 area ratio has been found to be the most important factor in reducing the decibel level of engine exhaust. In the preferred embodiment, this ratio is relatively large, and much greater than 1:1, to maximize frequency attenuation. In FIG. 7, it is shown that a muffler having a relatively large m ratio will have greater attenuation than a muffler having a relatively smaller m ratio, designated m'. However, both mufflers m and m' will emit similar frequencies.

In the present exhaust system 72, the expansion chamber 130 is located within the interior 120 of the muffler casing 118 and has an area substantially greater than an area of the muffler inlet 126 to optimally attenuate exhaust noise generated by the power head 12. Further, there is preferably an abrupt area change between the muffler inlet 126 and the expansion chamber 130. The expansion chamber 130 is preferably dimensioned to occupy a substantial portion of the casing interior 120.

Another important property of exhaust systems is the length of the expansion chamber 130. The length is adjusted to reduce the emission of targeted frequencies to suit the particular application. For optimum attenuation, the muffler curve should encounter the target frequencies at the peak of each node. In FIG. 7, the muffler curves mL and m'L attenuate the same target frequencies, i.e. 220 and 600 HZ. By changing the length L of the expansion chamber 130, the attenuated frequencies may be adjusted. In FIG. 7, the dashed curve mL' reflects frequency attenuation at 180, 475 and 800 HZ.

At its upper end 132, the expansion chamber 130 is provided with an expansion chamber outlet 134, which, due to the height or vertical length of the expansion chamber, is vertically displaced from the muffler outlet 128. The expansion chamber outlet 134 thus defines an upper end of an exhaust high rise portion 135 which is vertically displaced from the outlet 128 to define a zone of protection between the expansion chamber outlet and the muffler outlet. In addition, in the depicted embodiments, the outlet 134 of the expansion chamber 130 is axially displaced from the muffler inlet 126.

The provision of the present high rise portion feature is important when the hull 56 and the jet unit 10 are low in the water. This condition occurs when the power unit is turned off, or is operating at idle or at low speed. With the present high rise portion 135, ambient water migrating into the exhaust system 72 from the exhaust ports 116 will not reach the power unit 12 through the muffler inlet 126.

To cool the exhaust gases emitted from the power head 12 and directed into the muffler 34, the present exhaust system 72 includes at least one coolant port 136 through which ambient water is introduced into the muffler interior 120. The water is preferably drawn from the impeller chamber 16. A suitable water line (not shown) is provided to supply water to the port 136, which then sprays about the interior 120, and about the exterior of the expansion chamber 130 to mix with and cool the exhaust gases.

In the preferred embodiment, the coolant port 136 is located in close proximity to the outlet 134 of the expansion chamber 130. In addition, a cooling jacket 137 in fluid communication with a source of ambient coolant may be disposed about the expansion chamber 130 for supplemental cooling purposes. A spray shield 138 is attached to the muffler casing 118 and is disposed in vertically spaced relationship above the expansion chamber outlet 134 to allow free flow of gases, but to prevent the entry of cooling water into the outlet 134.

Referring now to FIG. 3, the exhaust system 72 of the jet unit 10 includes at least one resonator 140 for attenuating audible frequencies emitted by the power head 12. In the preferred embodiment, the resonator 140 takes the form of a resonator tube or pipe **140*a* which has a closed end 142 for attenuating a relatively narrow frequency band, and an opposite open end 144 in fluid communication with the muffler 34. In that the same length/attenuation properties described above in relation to expansion chambers apply to resonators, it is preferred that the resonator pipe 140*a* is dimensioned to extend a length equivalent to a portion of a wavelength to attenuate a specific target frequency. In the preferred embodiment, the length of the pipe 140*a*** is such that the pipe acts as a quarter-wavelength resonator for attenuating a target frequency.

The connection between the resonator **140*a* and the muffler 34 is made through a Tee fitting 146 which is placed between an end of the exhaust hose 50 and the gear housing 36. This resonator configuration has proved particularly effective in attenuating the pulse-type frequencies emitted by two-cycle power units 12**.

An alternate location for the resonator tube **140*a* is designated 147 and is located within the adaptor plate 20, either by fabrication or by casting (shown in phantom in FIG. 2). The resonator tube 147 is in fluid communication with the exhaust conduit 112** to attenuate specified frequencies of exhaust gases passing therethrough.

In addition, if desired, a second resonator 140 may be provided in the high rise portion 135 between the expansion chamber 130 and the outlet 134. This second resonator, designated **140*b*, takes the form of at least one and preferably two resonator ports opening out into the muffler casing interior 120. In applications where the resonator 140*b* is provided, the expansion chamber may be reduced in height and the outlet 132 may be displaced further from the expansion chamber 130 than is depicted in FIG. 3**.

Figure 6:
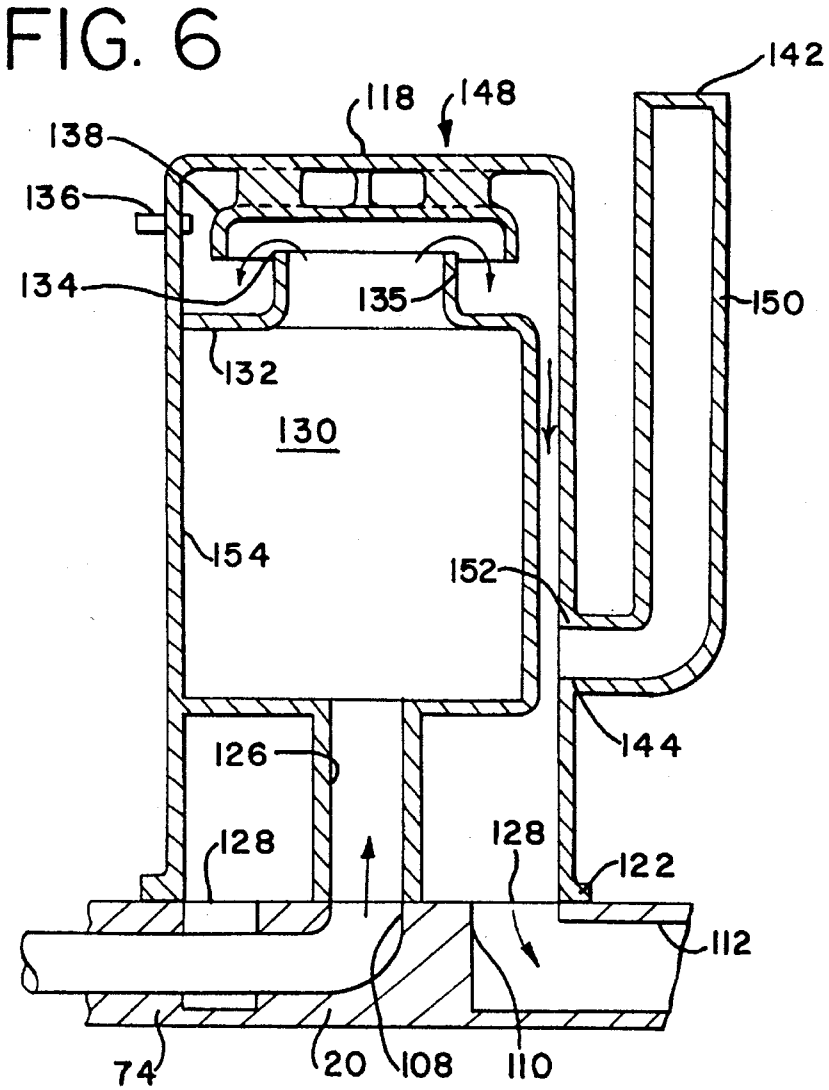
FIG. 6 is a vertical sectional view of a third alternate embodiment of a muffler suitable for use in the present exhaust system.

Referring now to FIG. 6, an alternate embodiment of the muffler 34 is designated 148. In this embodiment, features which are identical to the muffler 34 are designated with identical reference numerals. The muffler 148 differs most significantly from the muffler 34 in that the resonator **140*a* is now in the form of a resonator tube 150 attached directly to the muffler casing 118. Furthermore, the open end 144 of the resonator tube 150 is in fluid communication with the muffler interior 120 through a resonator port 152 located in the casing 118. In a preferred embodiment of the muffler 148, the resonator tube 150 is integrally cast with the casing 118. Also, if desired, the expansion chamber 130 may share a wall 154 with the muffler casing 118. It is preferred that the resonator port 152 is located relatively low on the casing 118 and is vertically displaced from the expansion chamber outlet 134 to provide for a longer pathway of the exhaust gases from the expansion chamber outlet. In this manner, additional sound attenuation may be achieved. Once the exhaust gases enter and exit the resonator tube 150 for attenuation of selected frequencies, they are directed through the muffler outlet 128**.

Figure 4:
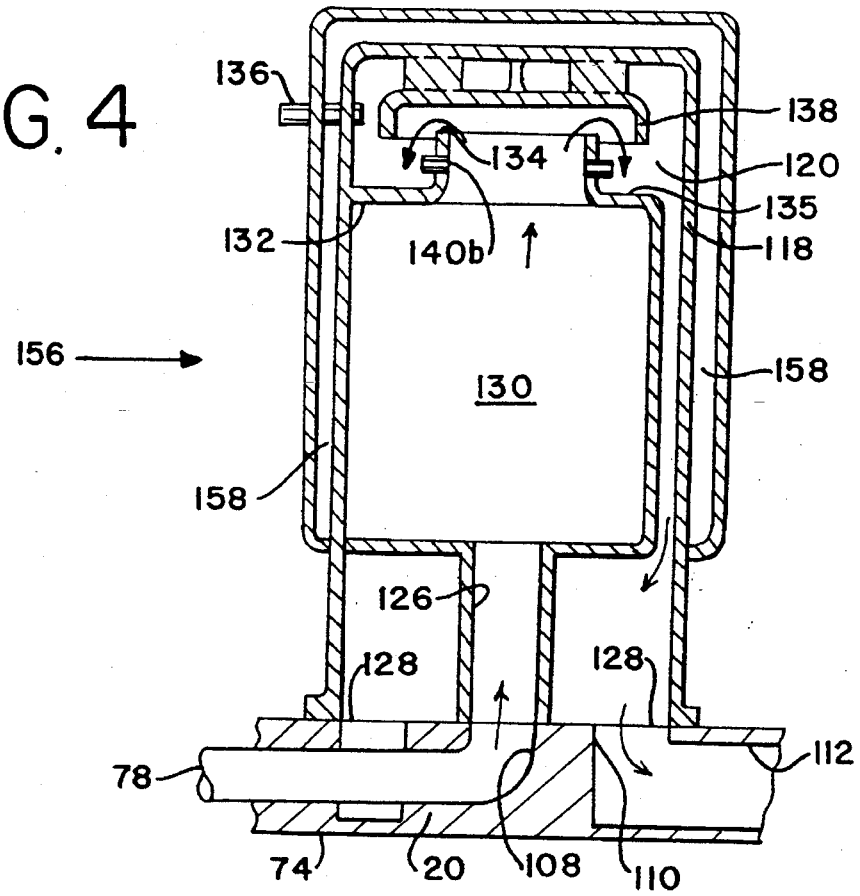
FIG. 4 is a vertical sectional view of an alternate embodiment of a muffler suitable for use in the present exhaust system.

Referring now to FIG. 4, another alternate embodiment of the muffler 34 is generally designated 156. The muffler 156 is substantially identical with the muffler 34, and as such, identical components have been designated with identical reference numerals. The principal difference between the muffler 34 and the muffler 156 is that the muffler 156 is provided with a water jacket 158 in addition to the coolant port 136. To provide additional cooling to the exhaust gases, the water jacket 158 is provided a supply of ambient water drawn from the impeller housing 16. Also, instead of the resonator tube 150, the muffler 156 is provided with at least two resonator pipes **140*b* which attenuate certain selected exhaust frequencies. It is contemplated that the water jacket 158 may also be provided to the embodiments of FIGS. 3, 5 or 6**.

Figure 5:
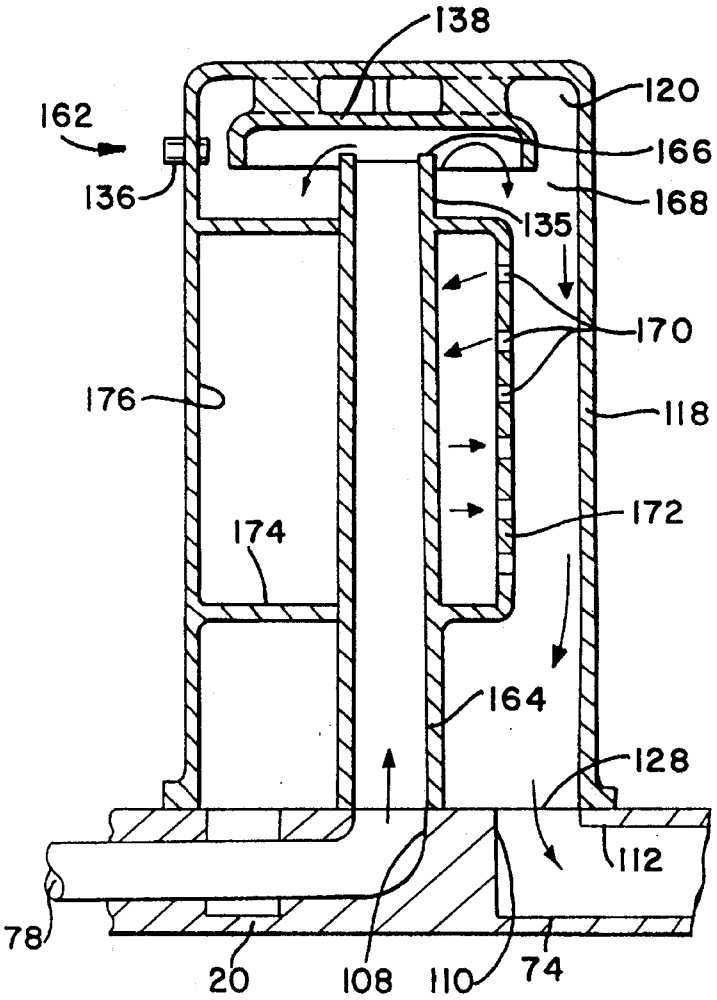
FIG. 5 is a vertical sectional view of a second alternate embodiment of a muffler suitable for use in the present exhaust system.

Referring now to FIG. 5, yet another alternate embodiment of the muffler 34 is generally designated 162. The muffler is similar to the muffler 34, and as before, identical components have been designated with identical reference numerals. In the muffler 162, the muffler inlet 126 has been expanded to an elongate inlet tube 164 which extends vertically from the base of the casing 118 almost to the spray shield 138. As in the other embodiments, however, the upper end 166 of the inlet tube 164, which generally corresponds to the expansion chamber outlet 132, is vertically displaced from the spray shield 138 to define a high rise portion which permits the circulation of gases while preventing the entry of cooling water into the inlet tube.

In the embodiment of FIG. 5, by virtue of the extended length of the inlet tube 164, the upper portion of the muffler interior 120 then becomes an expansion chamber 168. From the expansion chamber 168, the exhaust gases are directed downward past a series of resonator apertures 170 which are located in a side wall 172 of a resonator chamber 174. The resonator chamber 174 is internal to the muffler casing 118 and circumscribes the inlet tube 164. In the preferred embodiment, the resonator chamber 174 shares a wall with the muffler casing 118. After attenuation of some of the exhaust gases in the resonator chamber 174, the gases exit the muffler 162 from the muffler outlet 128.

In operation, and referring to the embodiments of FIGS. 2–4 and 6, exhaust gases from the power head 12 are introduced into the muffler 34 through the inlet 126. Since the inlet 126 is smaller in area than the expansion chamber 130, the gases undergo an initial expansion, and corresponding attenuation, once they reach the chamber 130. From the expansion chamber, the exhaust is attenuated by the resonator pipes **140*b* where present. Next, the exhaust passes out the high rise portion 135 and into the interior 120 of the muffler casing 118. At this point, the coolant sprayed from the port 136 mixes with and cools the gas as it expands again within the interior. This coolant moderates the temperature of the casing 118. In the embodiment of FIG. 4, additional cooling is provided by the water jacket 158**.

Referring to the embodiments of FIGS. 2–4, the gases are then passed from the muffler outlet 128, through the exhaust conduit 112 and the hose 50, and are further attenuated by the resonator pipe **140*a*. Subsequently, the exhaust is emitted from the unit 10 through the exhaust ports 116. In the embodiment of FIG. 6, the attenuation function performed by the resonator pipe 140*a* is instead performed by the resonator pipe 150 prior to the passage of the gases from the muffler outlet 128. In all of the above-described embodiments, the height and orientation of the exhaust high rise portion 135 prevents the entry into the muffler inlet, and ultimately into the power head 12, of ambient coolant which accumulates at the lower end of the interior 120**.

Referring now to the embodiment of FIG. 5, exhaust introduced into the inlet pipe 164 does not expand until it reaches the expansion chamber 166 located at the top of the interior 120. At the point of this expansion, the exhaust is cooled by the coolant emitted from the port 136 prior to contacting the casing 118. This feature tends to keep the casing from becoming excessively hot. From the expansion chamber 166, the exhaust passes through the resonator chamber 174 and circulates through the ports 170. Upon passage from the muffler 162, the exhaust may also be passed through a resonator pipe **140*a* as described in relation to FIG. 3**.

It will be seen that the advantages of the present exhaust system include the provision of a vertically extending high rise portion connected to the exhaust inlet for preventing the entry of water into the power head 12. In addition, the present exhaust system includes both internal and external resonators for customizing the attenuation of target frequencies. In some cases, the resonator may be located in the adaptor plate which connects the power head to the pump unit. Further, the present exhaust system is particularly well suited to the specific requirements of jet propulsion units equipped with power heads having a vertically depending crankshaft.

While a particular embodiment of the jet pump exhaust system of the invention has been shown and described, it will be appreciated by those skilled in the art that changes and modifications may be made thereto without departing from the invention in its broader aspects and as set forth in the following claims.

What is claimed is:

1. An exhaust system for a marine jet pump with an internal combustion power head connected to a pump unit, comprising:

a muffler provided with a casing defining an interior, a muffler inlet in fluid communication with the power head to receive exhaust gases therefrom, and a muffler outlet for emitting the exhaust gases;

an exhaust high rise portion having an outlet being vertically displaced from said inlet and said outlet to prevent the entry into said muffler inlet of cooling water passing into said interior through said muffler outlet;

resonating means in fluid communication with said muffler inlet, and indirectly located in an exhaust gas flow path defined by said muffler, for attenuating certain frequencies emitted by the power head;

coolant supply means in fluid communication with said interior for supplying ambient coolant to mix with and cool the exhaust gases; and a deflector shield disposed in spaced relationship to said high rise portion to permit the passage of exhaust gases therefrom, and also to prevent the entry of cooling water into said high rise portion.

2. The exhaust system as defined in claim 1 wherein said coolant supply means is disposed n close proximity to said high rise portion.

3. The exhaust system as defined in claim 1 wherein said resonating means includes at least one aperture in said high rise portion.

4. The exhaust system as defined in claim 1 wherein said muffler includes a casing, and said resonating means is integral with said casing.

5. The exhaust system as defined in claim 1 wherein said resonating means includes a resonator pipe being in fluid communication with said muffler inlet.

6. The exhaust system as defined in claim 5 wherein said resonator pipe is disposed externally of said muffler.

7. The exhaust system as defined in claim 5 wherein said resonator pipe is dimensioned to extend a length equivalent to a portion of a wavelength to attenuate a specific frequency.

8. The exhaust system as defined in claim 5 wherein said jet pump further includes an adaptor plate for connecting the power head to the pump unit, and said resonator pipe is disposed within said adaptor plate.

9. An exhaust system for a marine jet pump with an internal combustion power head, comprising:

a muffler including a muffler inlet in fluid communication with the power head to receive exhaust gases therefrom, and a muffler outlet for emitting the exhaust gases;

an expansion chamber located within said muffler and being in fluid communication with said muffler inlet and said muffler outlet, said expansion chamber having an area substantially greater than an area of said muffler inlet to attenuate exhaust noise generated by the power source;

resonating means being in fluid communication with said expansion chamber, and indirectly located in an exhaust gas flow path defined by said muffler, for attenuating audible frequencies emitted by the power source;

an exhaust high rise portion located within said muffler and being in fluid communication with said muffler inlet to receive exhaust gases passing therethrough and wherein said high rise portion is axially aligned with, and displaced from said inlet to prevent the entry into said inlet of water passing into said interior through said muffler outlet.

10. The exhaust system as defined in claim 9 wherein said muffler outlet is connected to an exhaust conduit and said resonating means includes a resonator pipe having at least one end in fluid communication with said exhaust conduit.

11. The exhaust system as defined in claim 9 wherein said resonator pipe is dimensioned to extend a length equivalent to a portion of a wavelength to attenuate a specific frequency.

12. The exhaust system as defined in claim 9 further including coolant supply means for introducing ambient coolant into said interior to mix with and cool exhaust gases introduced into said interior, and further including a deflector shield disposed in displaced relationship to said high rise portion for permitting the passage of exhaust gases therefrom, and also for preventing the entry of coolant from said supply means into said high rise portion.

13. The exhaust system as defined in claim 9 including an exhaust high rise portion, and wherein said resonating means includes at least one aperture in said high rise portion.

14. The exhaust system as defined in claim 9, wherein said muffler inlet extends vertically within said muffler to form a high rise portion, and said resonating means includes a resonating chamber circumscribing said high rise portion, and having at least one resonating aperture.

15. An exhaust system for a marine jet pump with an internal combustion power head connected to a pump unit, comprising:

a muffler provided with a casing defining an interior, a muffler inlet in fluid communication with the power head to receive exhaust gases therefrom, and a muffler outlet for emitting the exhaust gases;

an exhaust high rise portion having an outlet being vertically displaced from said inlet and said outlet to prevent the entry into said muffler inlet of cooling water passing into said interior through said muffler outlet;

coolant supply means in fluid communication with said interior for supplying ambient coolant to mix with and cool said exhaust gases; and a deflector shield disposed in spaced relationship to said high rise portion to permit the passage of exhaust gases therefrom, and also to prevent the entry of cooling water from said supply means into said high rise portion.

16. An exhaust system for a marine jet pump with an internal combustion power head connected to a pump unit, comprising:

a muffler provided with a casing defining an interior, a muffler inlet in fluid communication with the power head to receive exhaust gases therefrom, and a muffler outlet for emitting the exhaust gases;

an exhaust high rise portion having an outlet being vertically displaced from said inlet and said outlet to prevent the entry into said muffler inlet of cooling water passing into said interior through said muffler outlet; and resonating means, in fluid communication with said muffler inlet, and indirectly located in an exhaust gas flow path defined by said muffler, for attenuating certain frequencies emitted by the power head, said resonating means further including a resonating chamber circumscribing said muffler inlet, and having at least one resonator aperture.

17. An exhaust system for a marine jet pump with an internal combustion power head connected to a pump unit, comprising:

a muffler provided with a casing defining an interior, a muffler inlet in fluid communication with the power head to receive exhaust gases therefrom, and a muffler outlet for emitting the exhaust gases;

an exhaust high rise portion having an outlet being vertically displaced from said inlet and said outlet to prevent the entry into said muffler inlet of cooling water passing into said interior through said muffler outlet;

resonating means in fluid communication with said muffler inlet, and indirectly located in an exhaust gas flow path defined by said muffler, for attenuating certain frequencies emitted by the power head, said resonating means includes a resonator pipe being in fluid communication with said muffler inlet.

18. The exhaust system as defined in claim 17 wherein said resonator pipe is disposed externally of said muffler.

19. The exhaust system as defined in claim 17 wherein said resonator pipe is dimensioned to extend a length equivalent to a portion of a wavelength to attenuate a specific frequency.

* * * * *